US008267628B2

(12) United States Patent
Noce et al.

(10) Patent No.: US 8,267,628 B2
(45) Date of Patent: Sep. 18, 2012

(54) THREADED ANCHOR FOR CONCRETE METAL DECK FLOORS

(75) Inventors: William T. Noce, Trabuco Canyon, CA (US); Soi Q. Hoang, San Gabriel, CA (US)

(73) Assignee: MW Engineering, Placentia, CA (US)

( * ) Notice: Subject to any disclaimer, the term of this patent is extended or adjusted under 35 U.S.C. 154(b) by 483 days.

(21) Appl. No.: 12/464,762

(22) Filed: May 12, 2009

(65) Prior Publication Data

US 2010/0290859 A1 Nov. 18, 2010

(51) Int. Cl.
*E04B 1/41* (2006.01)

(52) U.S. Cl. ..... 411/80.6; 411/82; 411/930; 52/698; 52/704; 52/742.15; 248/327; 248/343

(58) Field of Classification Search ..... 411/80.6, 411/82, 337, 366.1, 930; 52/741.1, 742.15, 52/698–700, 704, 742.14; 248/58, 59, 71, 248/327, 343

See application file for complete search history.

(56) References Cited

U.S. PATENT DOCUMENTS

| | | | | | |
|---|---|---|---|---|---|
| 2,214,756 | A | | 9/1940 | Walsh | |
| 3,372,523 | A | * | 3/1968 | Hall, Jr. | 52/699 |
| 3,405,497 | A | * | 10/1968 | McNair | 52/699 |
| 3,693,312 | A | | 9/1972 | Miller | |
| 3,722,165 | A | | 3/1973 | Forsberg et al. | |
| 3,742,809 | A | | 7/1973 | Zifferer | |
| 3,769,774 | A | * | 11/1973 | Barnes | 52/698 |
| 3,798,866 | A | * | 3/1974 | Werstein | 52/707 |
| 3,842,709 | A | | 10/1974 | Fuqua | |
| 3,843,080 | A | * | 10/1974 | Imai et al. | 248/58 |
| 3,850,535 | A | | 11/1974 | Howlett et al. | |
| 3,896,599 | A | * | 7/1975 | Werstein et al. | 52/704 |
| 3,960,047 | A | | 6/1976 | Liffick | |
| 4,007,563 | A | | 2/1977 | Nakagawa | |
| 4,083,162 | A | | 4/1978 | Regan et al. | |
| 4,117,643 | A | | 10/1978 | Lamothe | |
| 4,118,910 | A | * | 10/1978 | McSherry et al. | 52/699 |
| 4,211,048 | A | | 7/1980 | Naka | |
| 4,370,018 | A | | 1/1983 | Lane, III | |
| 4,726,561 | A | | 2/1988 | Worzala, Jr. | |
| 5,205,690 | A | * | 4/1993 | Roth | 411/82 |
| 5,428,936 | A | * | 7/1995 | Roth | 52/704 |
| 5,466,015 | A | | 11/1995 | Berenter | |
| 5,605,423 | A | * | 2/1997 | Janusz | 411/387.6 |
| 5,649,798 | A | | 7/1997 | Ito | |

(Continued)

FOREIGN PATENT DOCUMENTS

JP 59-140604 U 9/1984

(Continued)

*Primary Examiner* — Victor Batson
*Assistant Examiner* — Tyler Johnson
(74) *Attorney, Agent, or Firm* — Lewis and Roca LLP

(57) ABSTRACT

A threaded anchor for concrete metal deck floors includes a hollow plastic sleeve having an internally threaded top portion, a flared top end forming several outwardly-extending fingers, and a bottom end. A threaded bolt has a head end and a shaft with external threads mating with the threads of the hollow plastic sleeve. The shaft of the bolt includes internal threads having at least two different diameters. A nut is threaded to mate with the external threads on the bolt. In use, the assembled insert is punched in place through a hole formed in a metal deck layer. The fingers of the plastic sleeve collapse as the assembly is passed through the hole and expand below the deck. The nut is then tightened against the top of the deck to hold the insert in place.

4 Claims, 2 Drawing Sheets

U.S. PATENT DOCUMENTS

| | | | | |
|---|---|---|---|---|
| 5,653,078 | A | 8/1997 | Kies et al. | |
| 5,937,609 | A | 8/1999 | Roth | |
| 5,957,644 | A | 9/1999 | Vaughan | |
| 6,240,697 | B1 * | 6/2001 | Thompson et al. | 52/698 |
| 6,959,902 | B2 * | 11/2005 | Leahy | 248/548 |
| 7,093,400 | B1 * | 8/2006 | Thompson et al. | 52/698 |
| 8,201,381 | B2 * | 6/2012 | Heath | 52/745.21 |
| 2007/0095004 | A1 | 5/2007 | Heath | |
| 2009/0272067 | A1 * | 11/2009 | Gilham | 52/707 |

FOREIGN PATENT DOCUMENTS

| | | | |
|---|---|---|---|
| JP | 2-200936 | A | 8/1990 |
| JP | 4-761136 | A | 3/1992 |
| JP | 5-230893 | A | 9/1993 |

* cited by examiner

THREADED ANCHOR FOR CONCRETE METAL DECK FLOORS

BACKGROUND

1. Field of the Invention

The present invention relates generally to anchors for poured concrete metal deck floors in multi-story buildings and used as support points for suspended utilities such as plumbing, piping, mechanical equipment, cable trays, bus ducts, HVAC ducts, electrical conduit, conduit racks, junction boxes and the like. More particularly, the present invention pertains to new and improved threaded anchors for poured concrete metal deck floors.

2. The Prior Art

Anchors for concrete wood form and concrete metal deck floors are known in the art. A threaded stud having a plate attached to its body, or an elongated nut having a bolt threaded into one end and a plate attached to its body have been used to provide suspension points for support rods that are used to suspend utilities and utility racks from ceilings, which are formed from concrete poured onto a metal deck floor surface of the floor above.

The size of the support rods utilized in a given application will vary depending on load requirements and upon the kind of utilities that are being suspended. Once anchors are in place, the size of the suspension rods cannot be changed. Moreover, many of these devices are used in the construction of a single building, making the labor required to install them a non-trivial factor.

BRIEF DESCRIPTION

According to a first aspect of the present invention, a threaded anchor for concrete metal deck floors includes a hollow plastic sleeve having an internally threaded top portion and a flared top end forming several outwardly-extending fingers. A threaded bolt has a head end and a shaft with external threads mating with the threads of the hollow plastic sleeve. The shaft of the bolt includes internal threads having at least two different diameters. A nut is threaded to mate with the external threads on the bolt. In use, the assembled insert is punched in place through a hole formed in a metal deck layer. The fingers of the plastic sleeve collapse as the assembly is passed through the hole and expand below the deck. The nut is then tightened against the top of the deck to hold the insert in place.

In use, the assembled insert is punched in place through a hole formed in a metal deck layer. The fingers of the plastic sleeve collapse as the assembly is passed through the hole and expand below the deck. The nut is then tightened against the top of the deck to hold the insert in place.

According to another aspect of the present invention, the plastic sleeve may be removed from the insert after the concrete above the metal deck layer has cured, and an elongated nut threaded onto the portion of the bolt that extends below the metal deck layer. This allows a larger support rod to be employed with the insert of the present invention.

BRIEF DESCRIPTION OF THE DRAWING FIGURES

DETAILED DESCRIPTION

Persons of ordinary skill in the art will realize that the following description of the present invention is illustrative only and not in any way limiting. Other embodiments of the invention will readily suggest themselves to such skilled persons.

Figure 1:
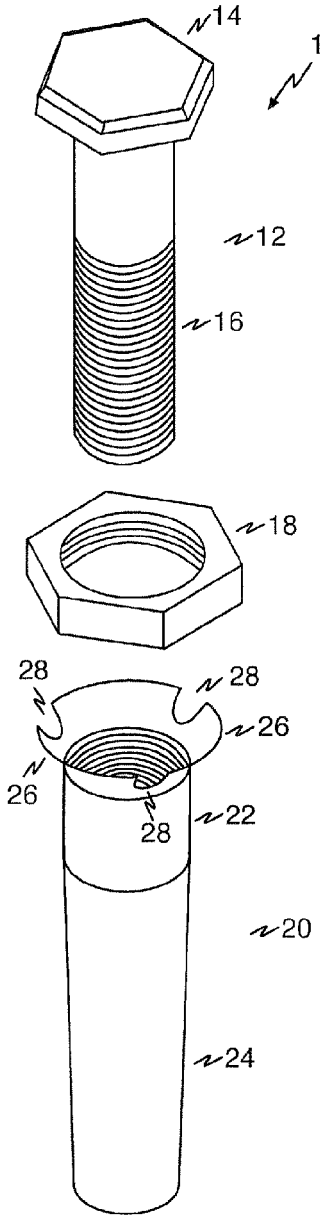
FIG. 1 is a drawing showing an exploded isometric view of all of the components of an illustrative threaded anchor for concrete metal deck floors according to one aspect of the present invention.

Referring first to FIG. 1, According to a first aspect of the present invention, an exploded view of a threaded anchor 10 for concrete metal deck floors includes a bolt 12 including head 14 and external threads 16. In an exemplary embodiment, bolt 12 may be a ⅞ inch bolt having a 3 inch shaft, a thread length of 2 inches and a head width of 1½ inches although persons skilled in the art will appreciate that this is one example of many possible design configurations. A nut 18 is threaded to mate with bolt 12.

A hollow sleeve 20, formed from a material such as plastic, includes an internally-threaded top portion 22. The internal threads of portion 22 mate with the external threads of bolt 12. A lower portion 24 extends beyond the internally-threaded portion 22 of the body of hollow sleeve 20. Hollow sleeve 20 also includes a flared top end forming several outwardly-extending fingers 26 separated and defined by voids 28. In one example embodiment, plastic sleeve 20 may have an overall height of about 4⅛ inches, with a bottom portion having a height of about 3 inches, a top threaded portion having a height of about 0.88 inches and flared top end having a height of about 0.25 inches. The bottom portion may be tapered as is shown in FIG. 1. Persons skilled in the art will observe that these dimensions (as are the other dimensions suggested herein for other elements of the invention) are not limiting, but merely represent one of a large number of possible embodiments.

Figure 2:
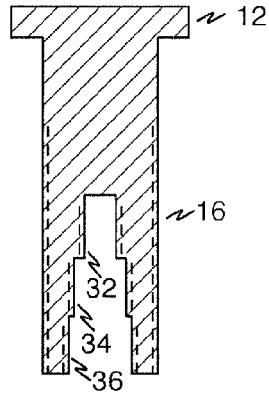
FIG. 2 is a cross-sectional view of an illustrative internally-threaded bolt that may be used as a component of a threaded anchor for concrete metal deck floors according to the present invention.

Referring now to FIG. 2, it may be seen that bolt 12 includes internal threads having at least two different diameters. The embodiment shown in FIG. 2 includes three internally threaded portions 32, 34, and 36, having different diameters. In an exemplary embodiment, threaded portions 32, 34, and 36 may have lengths of 7/16 inch, 9/16 inch, and ¾ inch, respectively.

Figure 3:
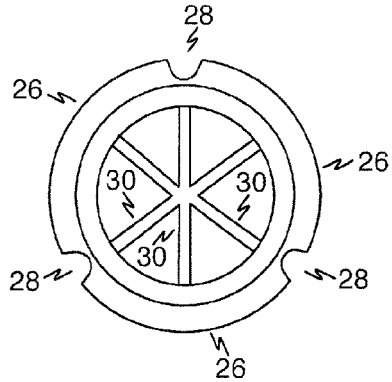
FIG. 3 is a top view of the plastic sleeve component of FIG. 1.

Referring now to FIG. 3, a top view of the hollow sleeve 20 shows outwardly extending fingers 26 defined by voids 28. As also may be seen in FIG. 3, the bottom of hollow sleeve 20 is provided with a plurality of slits 30, through which a threaded support rod may be introduced into the body of hollow sleeve 20 and threaded into one of the internally-threaded portions 32, 34, and 36 of bolt 12. In one exemplary non-limiting example embodiment, three 1/32 inch by ⅝ inch slits are employed. The support rod is used to suspend utilities and utility racks from the bottom of the flooring to which the threaded anchor 10 is mounted.

Figure 4:
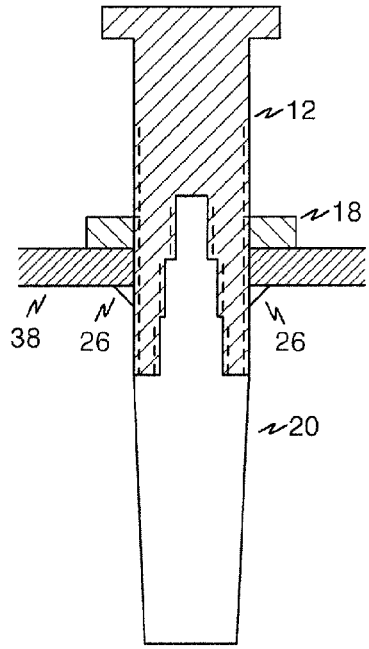
FIG. 4 is a cross-sectional view of an illustrative threaded anchor shown mounted to a concrete metal deck floor according to the present invention.

To mount the insert 10, the nut 18 is threaded into the external threads 16 of the bolt 12 and the internal threaded portion 22 of the plastic sleeve 20 is also threaded onto bolt 12. The assembled insert is punched in place through a hole formed in a metal deck layer 38 as shown in FIG. 4. The fingers 26 of the hollow sleeve 20 collapse as the assembly is passed through the hole in the metal deck layer 38 and then expand below the metal deck layer 38 as shown in FIG. 4. The nut 18 is then tightened on bolt 12 against the top of the metal deck layer 38 to hold the insert 10 in place. Because the bolt 12 is held securely to the metal deck layer 38 by the nut 18 and the fingers 26 of the plastic sleeve, the entire insert is disposed at an orientation perpendicular to the metal deck layer 38, and is held there in a stable manner while concrete is poured over the upper surface of metal deck layer 38.

Figure 5:
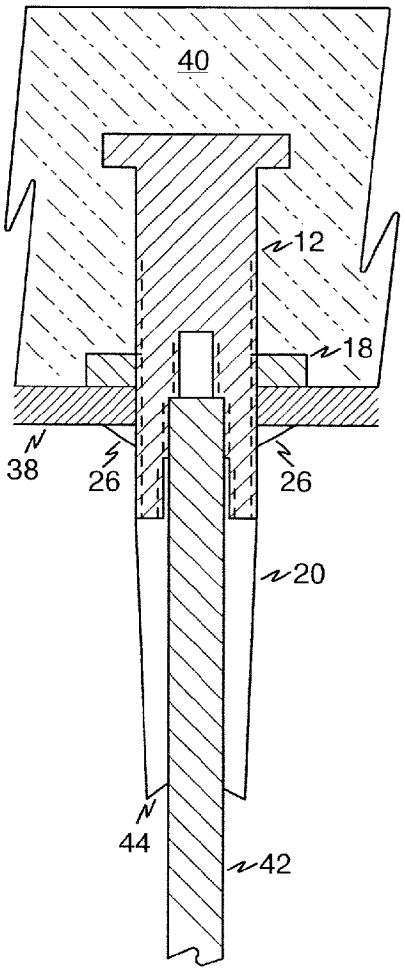
FIG. 5 is a cross-sectional view of an illustrative threaded anchor shown mounted to a concrete metal deck floor including a support rod threaded into the bolt according to the present invention.

Referring now to FIG. 5, after all of the inserts are mounted to the metal deck layer 38, a layer concrete 40 is poured over the metal deck layer 38 and allowed to cure as is known in the art. A metal support rod 42 is inserted into plastic sleeve 20, deforming the bottom material shown at reference numeral 44 segmented by slits 30 (FIG. 3). An externally-threaded end of metal support rod 42 is then threaded into one of the internally-threaded portions of bolt 12.

Figure 6:
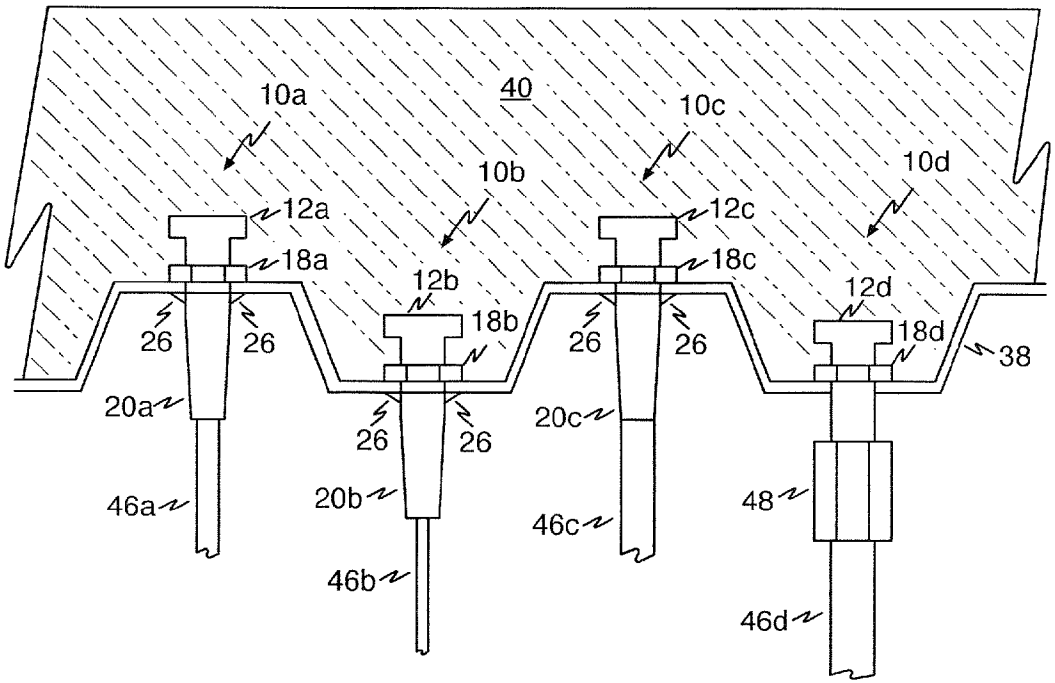
FIG. 6 is a drawing showing a plurality of illustrative threaded anchors for concrete metal deck floors mounted to metal deck flooring including various support rods according to another aspect of the present invention.

Referring now to FIG. 6, other features of the present invention are illustrated. FIG. 6 is a diagram that shows four illustrative inserts 10*a* through 10*d* mounted to metal deck layer 38. A layer of concrete 40 has been poured over metal deck layer 38 and allowed to cure as is known in the art.

Insert 10*a* includes bolt 12*a*, nut 18*a* threaded onto bolt 12*a*, and plastic sleeve 20*a* threaded onto the portion of bolt 12*a* extending below the bottom surface of metal deck layer 38. An externally-threaded end of support rod 46*a* is threaded into one of internal threaded portions 32, 34, and 36 of bolt 12*a*.

Insert 10*b* includes bolt 12*b*, nut 18*b* threaded onto bolt 12*b*, and plastic sleeve 20*b* threaded onto the portion of bolt 12*b* extending below the bottom surface of metal deck layer 38. An externally-threaded end of support rod 46*b* is threaded into one of internal threaded portions 32, 34, and 36 of bolt 12*b*.

Insert 10*c* includes bolt 12*c*, nut 18*c* threaded onto bolt 12*c*, and plastic sleeve 20*c* threaded onto the portion of bolt 12*c* extending below the bottom surface of metal deck layer 38. An externally-threaded end of support rod 46*c* is threaded into one of internal threaded portions 32, 34, and 36 of bolt 12*c*.

From an examination of FIG. 5, persons of ordinary skill in the art will observe that support rods 46*a*, 46*b*, and 46*c* have different diameters, support rod 46*b* having the smallest diameter, and support rod 46*c* having the largest diameter. This feature of the present invention makes the inserts 10*a* through 10*c* more versatile by virtue of the ability to support varying loads. In one exemplary embodiment, support rod 46*a* may be a ⅝ inch threaded rod, support rod 46*b* may be a ½ inch threaded rod, and support rod 46*c* may be a ¾ inch threaded rod, and that internally-threaded portions 32, 34, and 36 of bolts 12*a*, 12*b*, and 12*c* may be matingly configured to match the rods 46*a*, 46*b*, and 46*c*. Exemplary thread configurations are, for example, ⅜ inch –16 UNC 2B thread, ½ inch 13 UNC 2B thread, and ⅝ inch –11 UNC 2b thread, although persons of ordinary skill in the art will readily understand that these configurations are merely examples and that other diameters and thread sizes may be employed.

FIG. 6 also shows an additional feature of the present invention made possible by its configuration is shown with respect to insert 10*d*. Insert 10*d* includes bolt 12*d*, nut 18*d* threaded onto bolt 12*d*. Unlike the inserts 10*a* through 10*c*, insert 10*d* has had its hollow sleeve removed. This may be done by simply disengaging the threads between the bolt 12*d* and the hollow sleeve once the concrete 40 has cured and the bolt 12 is held by the cured concrete so that it will not rotate. An elongated nut 48 is externally threaded onto the bottom portion of bolt 10*d* that extends below the bottom surface of metal deck layer 38. An externally-threaded end of support rod 46*d* is threaded into the exposed end of elongated nut 48.

As will be appreciated by persons of ordinary skill in the art, because a larger diameter support rod 46*d* may be threaded onto elongated nut 48 at the end of bolt 12*d*, insert 10*d* is capable of supporting larger loads than would be possible using the largest-diameter support rod 46*c* that may be internally threaded into any one of bolts 12*a* through 12*c*.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A threaded anchor for concrete metal deck floors consisting of:

an elongate hollow sleeve having internal threads in at least a top portion thereof and a flared top end forming several outwardly-extending fingers, the fingers having distal ends that contact a lower surface of the metal deck floor when the threaded anchor is deployed in the metal deck floor, the elongate hollow sleeve further including a bottom end;

a threaded bolt having a head end and a shaft having external threads mating with the internal threads of the elongate hollow sleeve, a distal end of the shaft including three internally-threaded portions having different diameters for mating with threaded support rods to support varying loads; and a nut having threads that mate with the external threads on the bolt, the nut having a lower surface that contacts an upper surface of the metal deck floor when the threaded anchor is deployed in the metal deck floor.

2. A threaded anchor for concrete metal deck floors consisting of:

an elongate hollow sleeve having internal threads in at least a top portion thereof and a flared top end forming several outwardly-extending fingers, the fingers having distal ends that contact a lower surface of the metal deck floor when the threaded anchor is deployed in the metal deck floor, the elongate hollow sleeve further including a bottom end;

a threaded bolt having a head end and a shaft having external threads mating with the internal threads of the elongate hollow sleeve, a distal end of the shaft including three internally-threaded portions having different diameters for mating with threaded support rods to support varying loads;

wherein the bolt is at least a ⅞-inch bolt and has a shaft having a length of at least 3 inches; and a nut having threads that mate with the external threads on the bolt, the nut having a lower surface that contacts an upper surface of the metal deck floor when the threaded anchor is deployed in the metal deck floor.

3. A threaded anchor for concrete metal deck floors consisting of:

an elongate hollow sleeve formed from plastic material and having internal threads in at least a top portion thereof and a flared top end forming several outwardly-extending fingers, the fingers having distal ends that contact a lower surface of the metal deck floor when the threaded anchor is deployed in the metal deck floor, the elongate hollow sleeve further including a bottom end;

a threaded bolt having a head end and a shaft having external threads mating with the internal threads of the elongate hollow sleeve, a distal end of the shaft including three internally-threaded portions having different diameters for mating with threaded support rods to support varying loads; and a nut having threads that mate with the external threads on the bolt, the nut having a lower surface that contacts an upper surface of the metal deck floor when the threaded anchor is deployed in the metal deck floor.

4. A threaded anchor for concrete metal deck floors consisting of:

an elongate hollow sleeve having internal threads in at least a top portion thereof and a flared top end forming several outwardly-extending fingers, the fingers having distal ends that contact a lower surface of the metal deck floor when the threaded anchor is deployed in the metal deck floor, the elongate hollow sleeve further including a bottom end, wherein the bottom end of the elongate hollow sleeve includes a bottom surface having at least one slit formed thereacross;

a threaded bolt having a head end and a shaft having external threads mating with the internal threads of the elongate hollow sleeve, a distal end of the shaft including three internally-threaded portions having different diameters for mating with threaded support rods to support varying loads; and a nut having threads that mate with the external threads on the bolt, the nut having a lower surface that contacts an upper surface of the metal deck floor when the threaded anchor is deployed in the metal deck floor.

* * * * *